US009773606B2

(12) United States Patent
Yen et al.

(10) Patent No.: US 9,773,606 B2
(45) Date of Patent: Sep. 26, 2017

(54) INTEGRATED STACKED TRANSFORMER

(71) Applicant: Realtek Semiconductor Corp., HsinChu (TW)

(72) Inventors: Hsiao-Tsung Yen, Hsinchu (TW); Yuh-Sheng Jean, Hsinchu County (TW); Ta-Hsun Yeh, Hsinchu (TW)

(73) Assignee: Realtek Semiconductor Corp., HsinChu (TW)

( * ) Notice: Subject to any disclaimer, the term of this patent is extended or adjusted under 35 U.S.C. 154(b) by 193 days.

(21) Appl. No.: 14/690,477

(22) Filed: Apr. 20, 2015

(65) Prior Publication Data

US 2015/0310980 A1 Oct. 29, 2015

(30) Foreign Application Priority Data

Apr. 23, 2014 (TW) ..... 103114707 A

(51) Int. Cl.
*H01F 5/00* (2006.01)
*H01F 27/28* (2006.01)
*H01F 19/04* (2006.01)

(52) U.S. Cl.
CPC ..... *H01F 27/2804* (2013.01); *H01F 5/00* (2013.01); *H01F 19/04* (2013.01); *H01F 2027/2809* (2013.01)

(58) Field of Classification Search
CPC ..... H01F 5/00; H01F 27/00–27/30
USPC ..... 336/65, 200, 232
See application file for complete search history.

(56) References Cited

U.S. PATENT DOCUMENTS

| | | | |
|---|---|---|---|
| 4,816,784 | A | 3/1989 | Rabjohn |
| 5,420,558 | A | 5/1995 | Ito |
| 6,396,362 | B1 | 5/2002 | Mourant |
| 6,559,751 | B2 | 5/2003 | Liu |
| 7,253,712 | B1 | 8/2007 | Papananos |
| 7,956,713 | B2 | 6/2011 | Chandrasekhar et al. |
| 8,581,684 | B2 | 11/2013 | Noiré |
| 2007/0247269 | A1 | 10/2007 | Papananos |
| 2012/0268229 | A1 | 10/2012 | Yen et al. |

*Primary Examiner* — Tuyen Nguyen
(74) *Attorney, Agent, or Firm* — Winston Hsu

(57) ABSTRACT

An integrated stacked transformer includes a primary inductor and a secondary inductor, and the primary inductor includes at least a first turn and a second turn, and is at least formed by a plurality of windings of a first metal layer and a second metal layer, wherein the first metal layer and the second metal layer are two adjacent metal layers, and the second turn of the primary inductor is disposed inside the first turn; the secondary inductor includes at least a first turn, and the secondary inductor is at least formed by at least one winding formed by the second metal layer, wherein the first turn of the secondary inductor substantially overlaps the first turn of the primary inductor; wherein the second turn of the primary inductor includes a segment of a parallel connection structure constructed by the first metal layer and the second metal layer.

13 Claims, 13 Drawing Sheets

INTEGRATED STACKED TRANSFORMER

BACKGROUND OF THE INVENTION

1. Field of the Invention

This present invention relates to a transformer, and more particularly, to an integrated stacked transformer.

2. Description of the Prior Art

Transformer and BALUN are the important components in radio frequency integrated circuit to implement single-ended to differential conversion, signal coupling, and impedance matching, etc. With integrated circuit developing toward system on chip (SOC), integrated transformer/BALUN replaces traditional discrete component gradually, and is applied in radio frequency integrated circuit widely. However, the passive components in integrated circuit such like inductor and transformer consume a lot of chip area in general cases. Therefore how to reduce the amount of passive component/components in integrated circuit and minimize the area of passive component/components and maximize the specification of component/components like quality factor Q and coupling coefficient K in the same time is an important issue.

SUMMARY OF THE INVENTION

One of the objectives of the present invention is providing an integrated stacked transformer, which has high quality factor and coupling coefficient, and is implemented with less metal layers to reduce the manufacturing costs and maximize the specification of component.

According to an embodiment of the present invention, an integrated stacked transformer comprises a primary inductor and a secondary inductor, wherein the primary inductor comprises at least one first turn and one second turn, and is at least formed by a plurality of windings formed by a first metal layer and a second metal layer, wherein the first metal layer and the second metal layer are two adjacent metal layers, and the second turn of the primary inductor is disposed inside the first turn; the secondary inductor comprises at least a first turn, and is at least formed by one winding which is formed by the second metal layer, wherein the first turn of the secondary inductor and the first turn of the primary inductor are substantially overlapped; wherein the second turn of the primary inductor comprises a segment of a parallel connection structure constructed by the first metal layer and the second metal layer.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
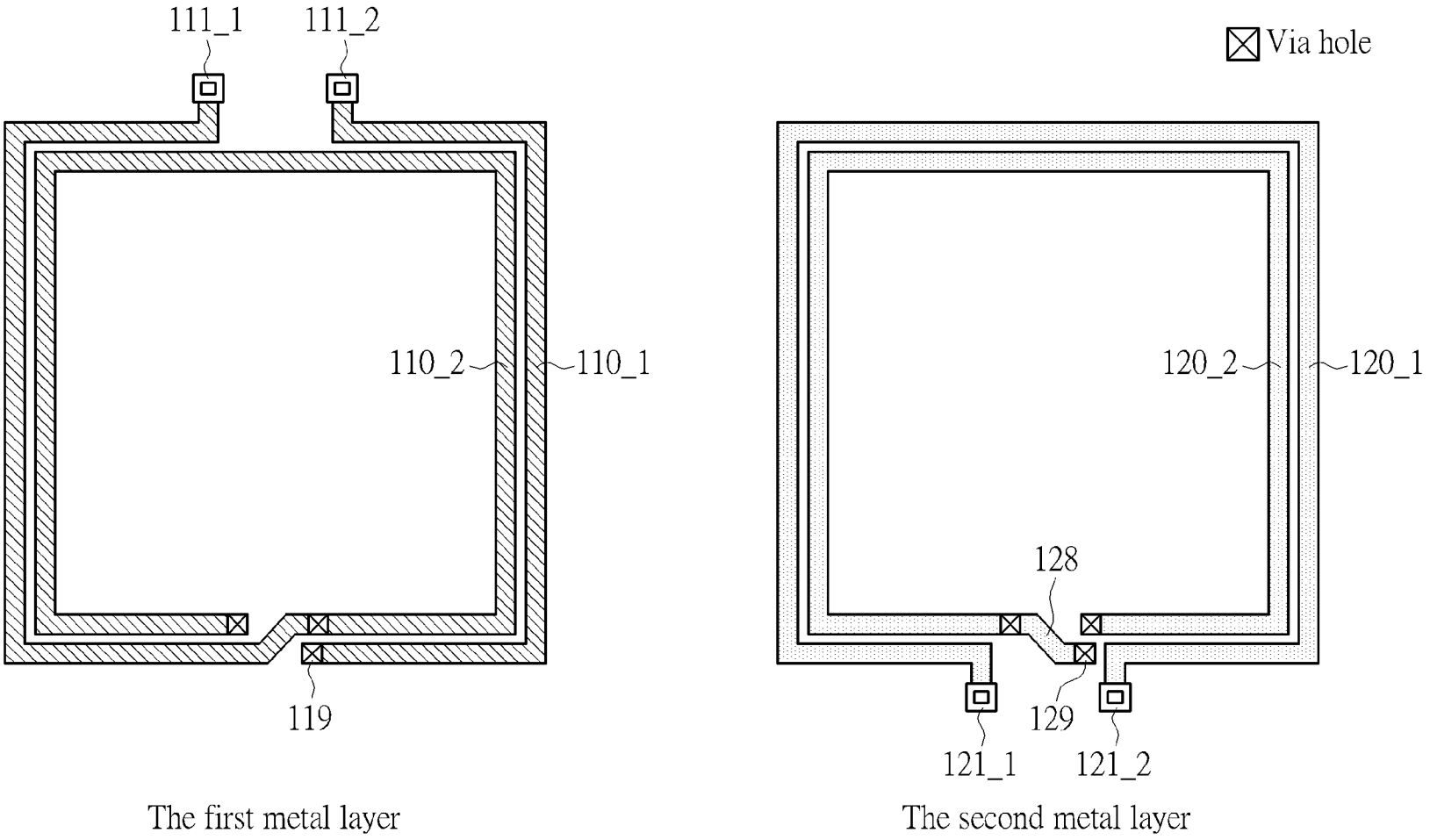
FIG. 1A is a diagram illustrating the patterns of two metal layers of the integrated stacked transformer according to the first embodiment of the present invention.
Figure 1B:
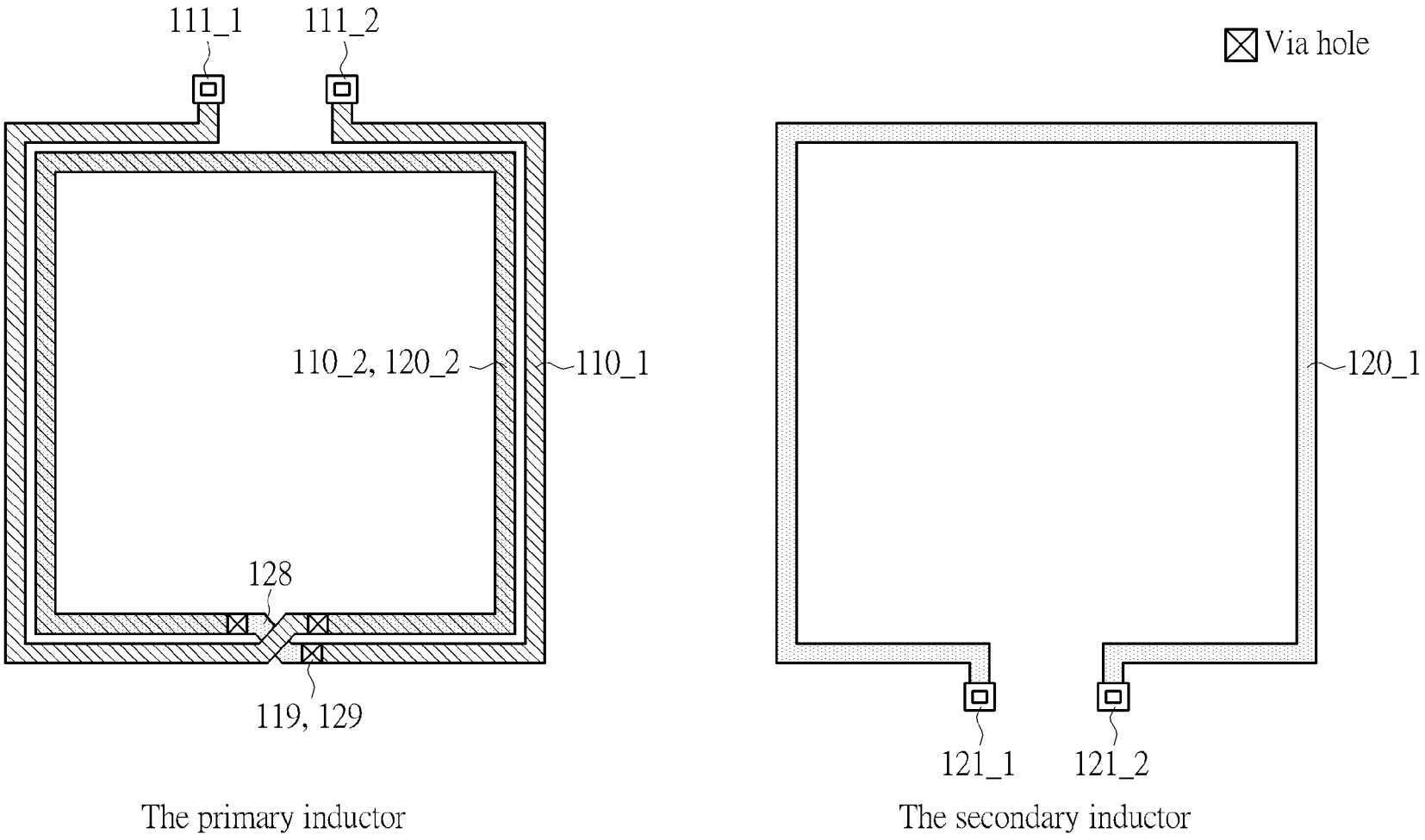
FIG. 1B is a diagram illustrating the primary inductor and the secondary inductor of the integrated stacked transformer in FIG. 1A.
Figure 1C:
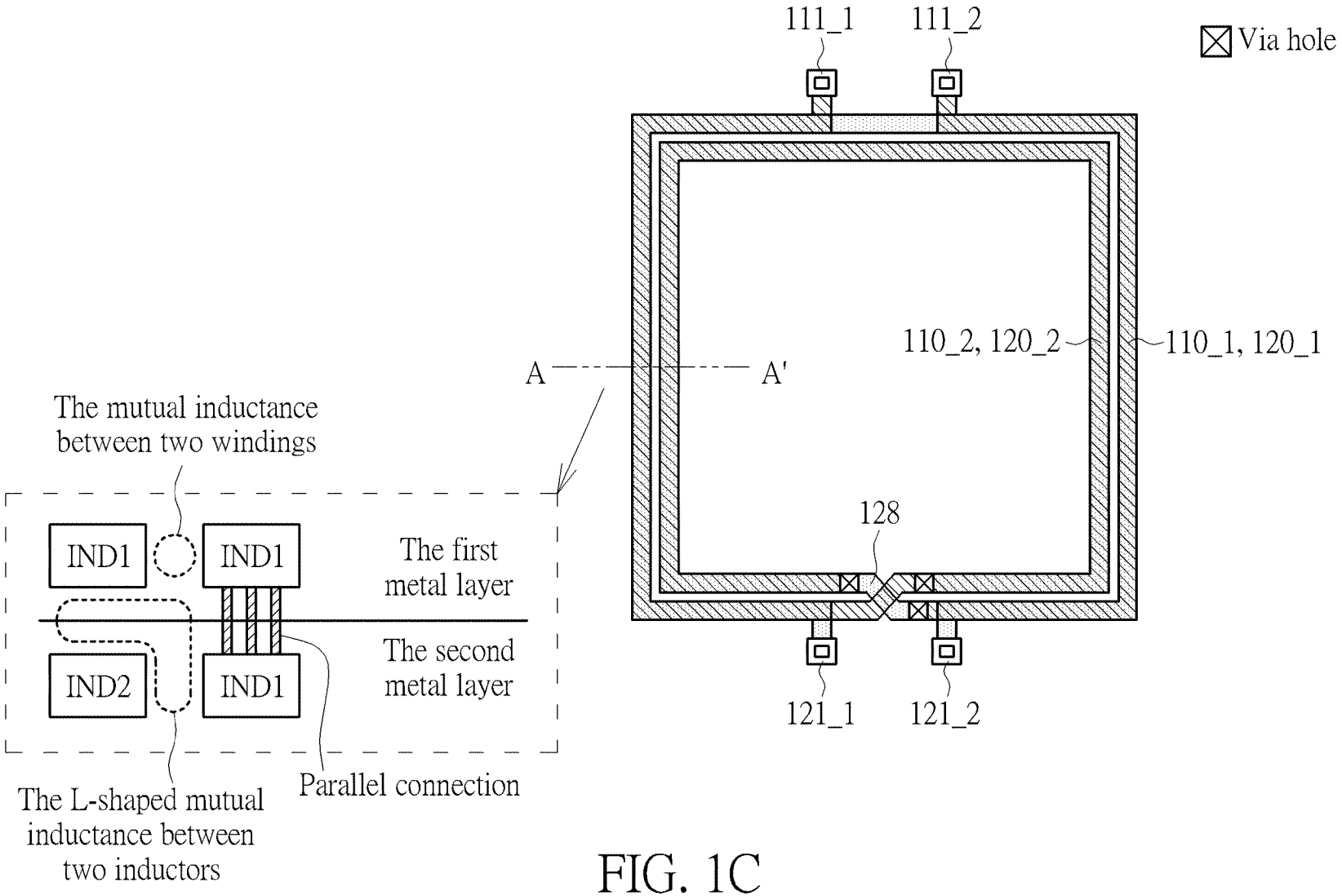
FIG. 1C is a diagram illustrating the top view and the cross-sectional view of the integrated stacked transformer according to the first embodiment of the present invention.

Refer to FIG. 1A, FIG. 1B and FIG. 1C, wherein FIG. 1A is a diagram illustrating the patterns of two metal layers of the integrated stacked transformer according to the first embodiment of the present invention, FIG. 1B is a diagram illustrating the primary inductor and the secondary inductor of the integrated stacked transformer according to the first embodiment of the present invention, and FIG. 1C is a diagram illustrating the top view and the cross-sectional view of the integrated stacked transformer according to the first embodiment of the present invention. The integrated stacked transformer in this embodiment can be applied to be a transformer or a BALUN in radio frequency integrated circuit.

Refer to FIG. 1A, the integrated stacked transformer is formed by a first metal layer and a second metal layer, wherein the pattern of the first metal layer in FIG. 1A comprises two input/output ports 111_1, 111_2, a first turn winding 110_1 and a second turn winding 110_2, and the pattern of the second metal layer comprises two input/output ports 121_1, 121_2, a bridge 128, a first turn winding 120_1 and a second winding 120_2, wherein the bridge 128 connects the second turn winding 110_2 of the first metal layer with the first turn winding 110_1 of the first metal layer. In addition, both the first metal layer and the second metal layer comprise a plurality of via holes arranged to connect the first metal layer with the second metal layer. For example the via hole 119 of the first metal layer in FIG. 1A is electrically connected to the via hole 129 of the second metal layer.

In addition, in this embodiment, the first metal layer is a re-distribution layer (RDL) and the second metal layer is an ultra-thick metal (UTM), however, this is not a limitation of the present invention. In other embodiments the first metal layer and the second metal layer can be any two adjacent metal layers in the integrated circuit.

Next, refer to FIG. 1A, FIG. 1B and FIG. 1C, the integrated stacked transformer in the embodiment comprises the primary inductor and the secondary inductor, wherein the primary inductor is electrically isolated from the secondary inductor, and the primary inductor comprises a first turn and a second turn. Refer to FIG. 1B, the first turn of the primary inductor except the area around the bridge 128 is formed by the first turn winding 110_1 of the first metal layer, and the second turn of the first inductor is a parallel connection structure constructed by the second turn winding 110_2 of the first metal layer and the second turn winding 120_2 of the second metal layer.

In addition, the second turn of the primary inductor is a parallel connection structure constructed by the second turn winding 110_2 of the first metal layer and the second turn winding 120_2 of the second metal layer. For the tidiness of figure, in FIG. 1B it only depicts two via holes arranged to connect the second turn winding 110_2 of the first metal layer with the second turn winding 120_2 of the second metal layer, however, in practice, the second turn winding 110_2 of the first metal layer can be connected with the second turn winding 120_2 of the second metal layer in parallel through a lot of via holes, or even via holes can be disposed all over the windings.

Refer to the top view of the integrated stacked transformer in FIG. 1C, each turn of the windings of the first metal layer and the second metal layer in FIG. 1A are overlapped, that is the first turn winding 110_1 of the first metal layer (i.e. the first turn of the primary inductor) and the first turn winding 120_1 of the second metal layer (i.e. the secondary inductor) are overlapped. In the cross-sectional view of A-A' of the FIG. 1C, IND1 is the primary inductor and IND2 is the secondary inductor. The first turn winding 110_1 and the second turn winding 110_2 of the first metal layer of the primary inductor form a mutual inductance between two windings. The secondary inductor (i.e. the first turn winding 120_1 of the second metal layer) and the first turn winding 110_1, the second turn winding 110_2 of the first metal layer of the primary inductor form a L-shaped mutual inductance between two inductors. Therefore, the integrated stacked transformer of this embodiment can improve the quality factor Q of the integrated stacked transformer, enhance the coupling quantity and consume less area. In addition, the mutual inductance between the primary inductor and the secondary inductor comprises the vertical coupling, the diagonal coupling and the horizontal coupling in short distance, that is the primary inductor and the secondary inductor form a mutual inductor by the vertical coupling, the diagonal coupling and the horizontal coupling in short distance.

In addition, the integrated stacked transformers in FIG. 1A, FIG. 1B and FIG. 1C are implemented with only two metal layers, therefore it can save the space in integrated circuit and reduce the manufacturing costs. Furthermore, the second metal layer in this embodiment is UTM which has the lowest resistance in metal process, so the resistance of the inductor may be improved to increase the quality factor.

Although the integrated stacked transformers in FIG. 1A, FIG. 1B and FIG. 1C can be implemented with only two metal layers, however, sometimes for other reasons such like improving the quality factor or there are some available space in the integrated circuit, one or more extra metal layers may be used to form a stacked structure. For example, a third metal layer disposed under the second metal layer may be used to connect with a portion of windings of either the primary inductor or the secondary inductor in parallel. These adjustments of design are supposed to be defined in the scope of the present invention.

Although the second turn of the primary inductor is a parallel connection structure constructed by the second turn winding 110_2 of the first metal layer and the second turn winding 120_1 of the second metal layer in the embodiments of FIG. 1A, FIG. 1B and FIG. 1C, however, in other embodiments of the present invention, only a portion of segments of the second turn of the primary inductor is designed to have the parallel connection structure, that is not all of the second turn of the primary inductor has the parallel connection structure. These adjustments of design are supposed to be defined in the scope of the present invention.

Figure 2A:
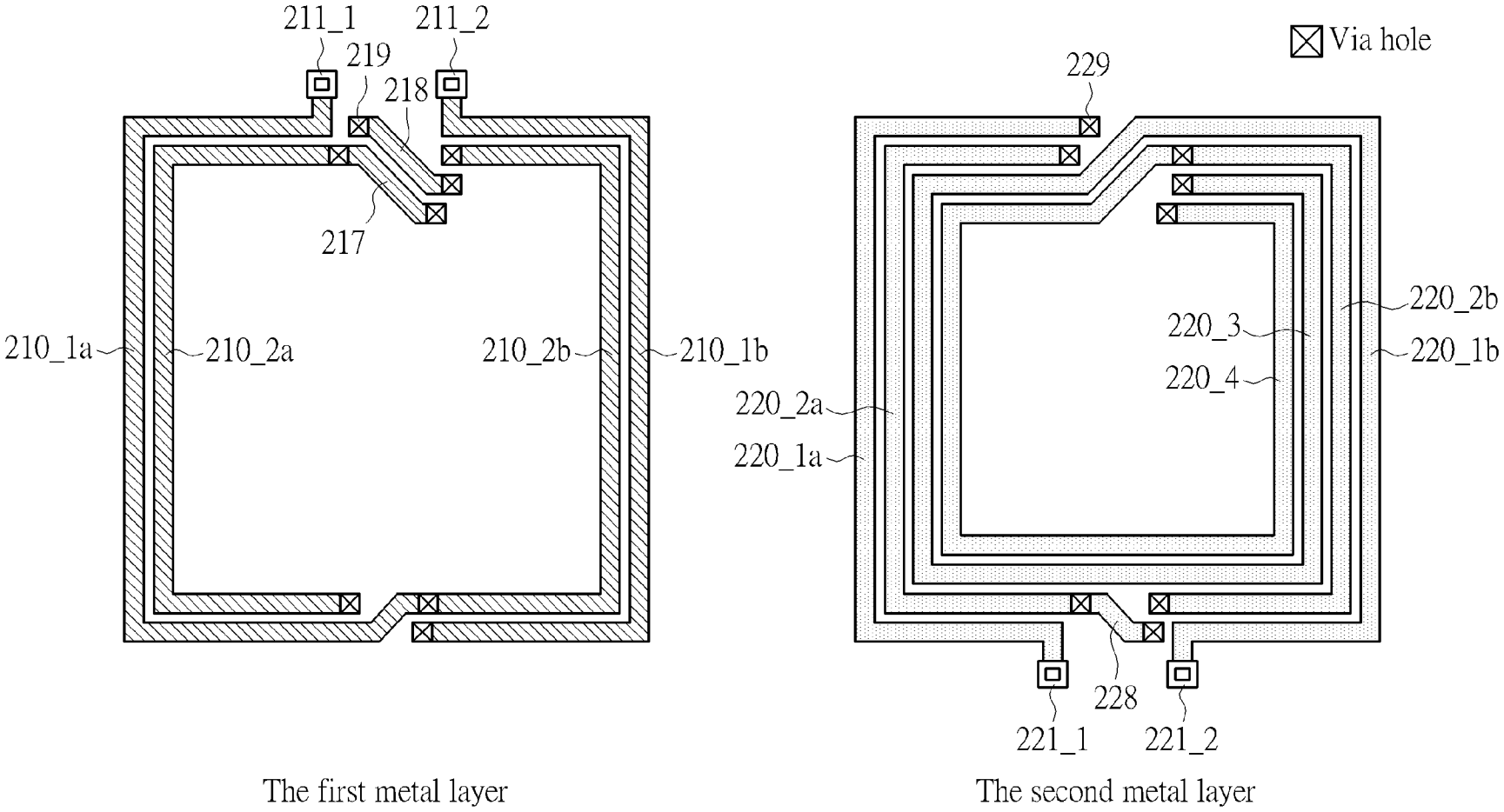
FIG. 2A is a diagram illustrating the patterns of two metal layers of the integrated stacked transformer according to the second embodiment of the present invention.
Figure 2B:
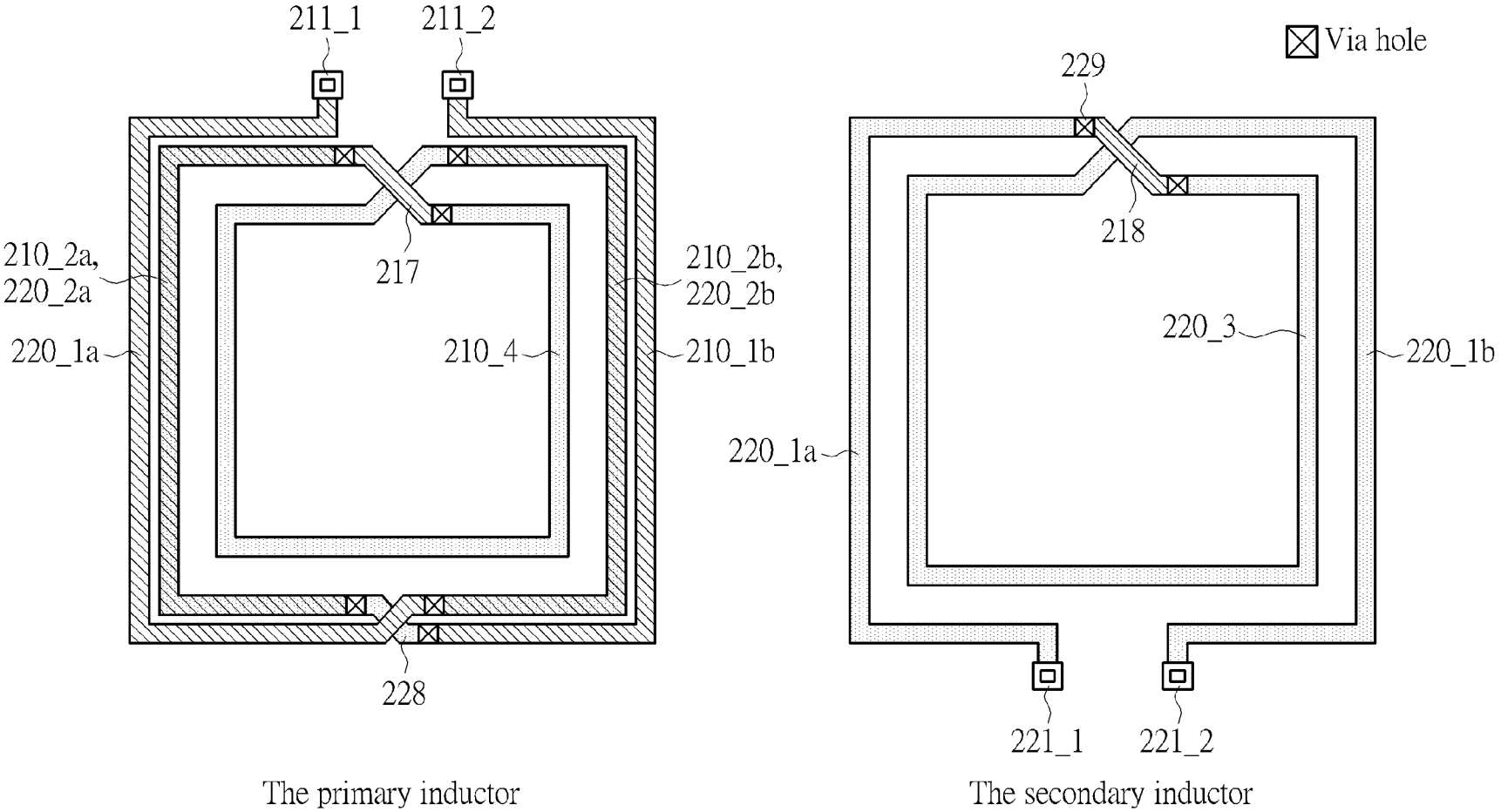
FIG. 2B is a diagram illustrating the primary inductor and the secondary inductor of the integrated stacked transformer in FIG. 2A.
Figure 2C:
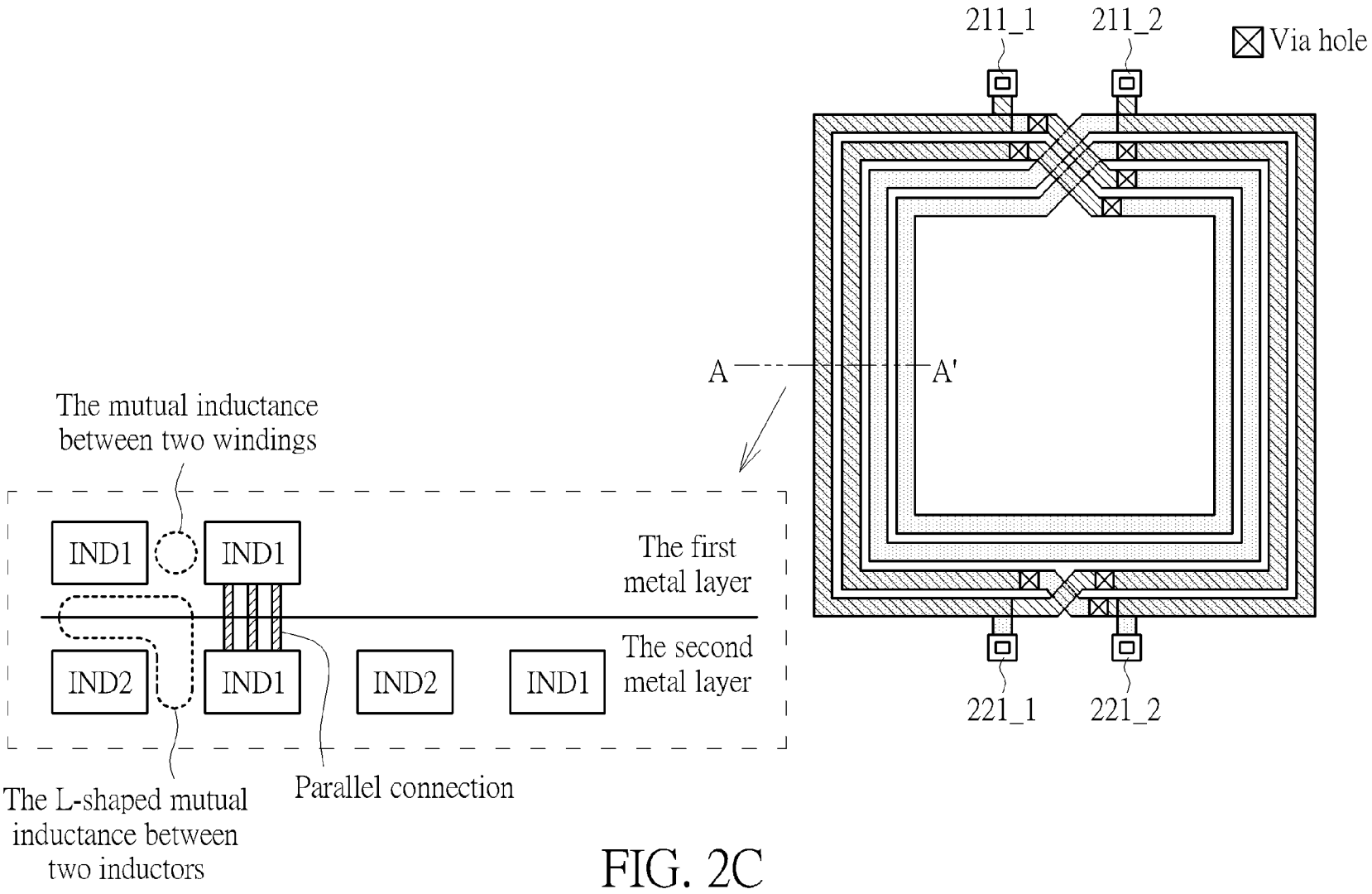
FIG. 2C is a diagram illustrating the top view and the cross-sectional view of the integrated stacked transformer according to the second embodiment of the present invention.

Refer to FIG. 2A, FIG. 2B and FIG. 2C, wherein FIG. 2A is a diagram illustrating the patterns of two metal layers of the integrated stacked transformer according to the second embodiment of the present invention, FIG. 2B is a diagram illustrating the primary inductor and the secondary inductor of the integrated stacked transformer according to the second embodiment of the present invention, and FIG. 2C is a diagram illustrating the top view of the integrated stacked transformer according to the second embodiment of the present invention. The integrated stacked transformer in this embodiment can be applied to be a transformer or a BALUN in radio frequency integrated circuit.

Refer to FIG. 2A, the integrated stacked transformer is formed by a first metal layer and a second metal layer, wherein the pattern of the first metal layer comprises two input/output ports 211_1, 211_2, two bridges 217 and 218, a first turn winding which comprises left half turn winding 210_1*a* and right half turn winding 210_1*b* and a second turn winding which comprises left half turn winding 210_2*a* and right half turn winding 210_2*b*; and the pattern of the second metal layer comprises two input/output ports 221_1, 221_2, a bridge 228, a first turn winding which comprises left half turn winding 220_1*a* and right half turn winding 220_1*b*, a second turn winding which comprises left half turn winding 220_2*a* and right half turn winding 220_2*b*, a third turn winding 220_3 and a fourth turn winding 220_4, wherein the bridge 217 is arranged to connect the left half turn winding 210_2*a* of the second turn winding of the first metal layer with the fourth turn winding 220_4 of the second metal layer (or can be regarded as connecting the left half turn winding 220_2*a* of the second turn winding of the second metal layer with the fourth turn winding 220_4 of the second metal layer), the bridge 218 is arranged to connect the left half turn winding 220_1*a* of the first turn winding of the second metal layer with the third turn winding 220_3 of the second metal layer, and the bridge 228 is arranged to connect the right half turn winding 210_1*b* of the first turn winding of the first metal layer with the left half turn winding 210_2*a* of the second turn winding of the first metal layer (or can be regarded as connecting the right half turn winding 210_1*b* of the first turn winding of the first metal layer with the left half turn winding 220_2*a* of the second turn winding of the second metal layer). In addition, both the first metal layer and the second metal layer comprise a plurality of via holes arranged to connect the first metal layer with second metal layer. For example the via hole 219 of the first metal layer is electrically connected to the via hole 229 of the second metal layer.

In addition, in this embodiment, the first metal layer is RDL and the second metal layer is UTM, however, this is not a limitation of the present invention. In other embodiments of the present invention, the first metal layer and the second metal layer can be any two adjacent metal layers in the integrated circuit.

Next, refer to FIG. 2A, FIG. 2B and FIG. 2C, the integrated stacked transformer in this embodiment comprise a primary inductor and a secondary inductor, wherein the primary inductor is electrically isolated from the secondary inductor, and the primary inductor comprises a first turn, a second turn and a third turn, and the secondary inductor comprises a first turn and a second turn. Refer to FIG. 2B, the first turn of the primary inductor except the area around the bridges 217 and 218 is formed by the first turn winding of the first metal layer which comprises the left half turn winding 210_1*a* and the right half turn winding 210_1*b*, the second turn of the primary inductor is a parallel structure constructed by the second turn winding of the first metal layer which comprises left half turn winding 210_2*a* and right half turn winding 210_2*b* and the second turn winding of the second metal layer which comprises left half turn winding 220_2*a* and right half turn winding 220_2*b*, and the third turn of the primary inductor is formed by the fourth turn winding 220_4 of the second metal layer. In addition, the first turn of the secondary inductor except the area around the bridge 218 is formed by the first turn winding of the second metal layer which comprises the left half turn winding 220_1*a* and the right half turn winding 220_1*b*, and the second turn of the secondary inductor is formed by the third turn winding 220_3 of the second metal layer.

The first turn, the second turn and the third turn of the primary inductor are spirally connected together, and the first turn and the second turn of the secondary inductor are also spirally connected together.

In addition, the second turn of the primary inductor is a parallel connection structure constructed by the second turn winding of the first metal layer which comprises the left half turn winding 210_2*a* and the right half turn winding 210_2*b* and the second turn winding of the second metal layer which comprises the left half turn winding 220_2*a* and the right half turn winding 220_2*b*. For the tidiness of figure, it only depicts four via holes arranged to connect the second turn winding of the first metal layer with the second turn winding of the second metal layer in FIG. 2B, however, in practice, the second turn winding of the first metal layer can be connected with the second turn winding of the second metal layer in parallel through a lot of via holes, or even via holes can be disposed all over the windings.

Refer the top view of the integrated stacked transformer in FIG. 2C, the first turn winding of the first metal layer (i.e. the first turn of the primary inductor) and the first turn winding of the second metal layer (i.e. the first turn of the secondary inductor) are overlapped. In the cross-sectional view of A-A' of the FIG. 2C, IND1 is the primary inductor, and IND2 is the secondary inductor. The first turn winding and the second turn winding of the first metal layer of the primary inductor form a mutual inductance between two windings, and the first turn of the secondary inductor (the first turn winding of the second metal layer) and the first turn winding, the second turn winding of the first metal layer and the second turn winding of the second metal layer of the primary inductor form a L-shaped inductance between two inductors, therefore the quality factor Q of the integrated stacked transformer can be improved greatly.

In addition, the integrated stacked transformers of FIG. 2A, FIG. 2B and FIG. 2C can be implemented with only two metal layers, and the first turn winding of the first metal layer (the first turn of the primary inductor) and the first turn winding of the second metal layer (the first turn of the secondary inductor) are overlapped. It therefore can save the space in integrated circuit, and reduce manufacturing costs further. In addition, in this embodiment the second metal layer is UTM which has the lowest resistance in metal process, so the resistance of the inductor can be improved to enhance the quality factor. Comparing to the embodiment in FIG. 1A, FIG. 1B and FIG. 1C, the integrated stacked transformers in FIG. 2A, FIG. 2B and FIG. 2C further comprise the spirally connected inside turns to the quality factor and the inductances.

In addition, the integrated stacked transformers of FIG. 2A, FIG. 2B and FIG. 2C can be implemented with only two metal layers, however, sometimes for other reasons suchlike improving the quality factor or there are some available space in integrated circuit, one or more extra metal layers may be used to form a stacked structure. For example a third metal layer under the second metal layer may be used to connect with a portion of windings of either the primary inductor or the secondary inductor in parallel. These adjustments of design are supposed to be defined in the scope of the present invention.

Although the second turn of the primary inductor is a parallel connection structure constructed by the second turn winding of the first metal layer which comprises the left half turn winding 210_2*a* and the right half turn winding 210_2*b* and the second turn winding of the second metal layer which comprises the left half turn winding 220_2*a* and the right half turn winding 220_2*b* in the embodiment of FIG. 2A, FIG. 2B and FIG. 2C, however, in other embodiments of the present invention, only a portion of segments of the second turn of the primary inductor is designed to have parallel connection structure, that is not all of the second turn of the primary inductor has the parallel connection structure. These adjustments of design are supposed to be defined in the scope of the present invention.

Figure 3:
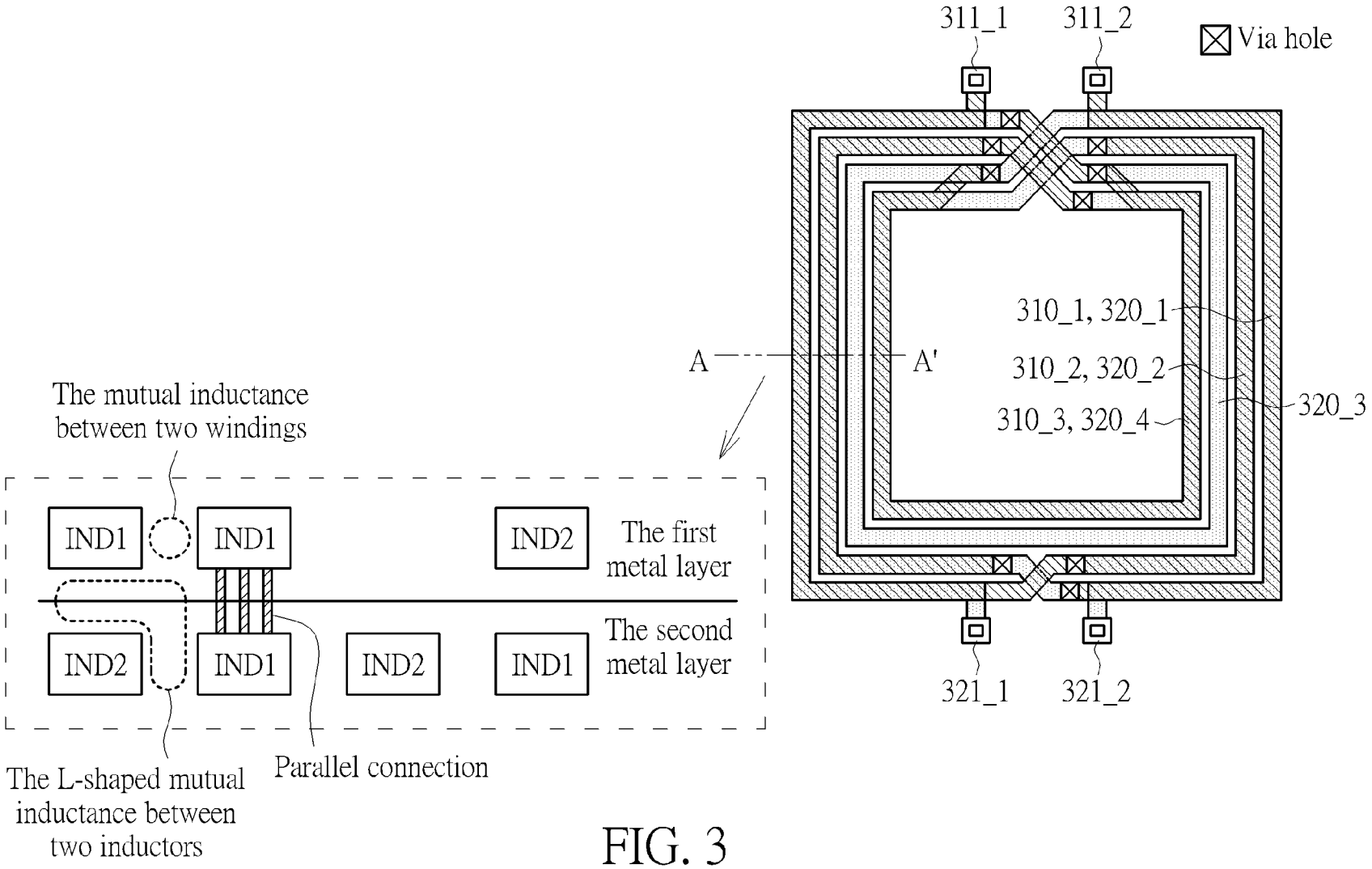
FIG. 3 is a diagram illustrating the top view and the cross-sectional view of the integrated stacked transformer according to the third embodiment of the present invention.

Refer to FIG. 3, which is a diagram illustrating the top view of the integrated stacked transformer according to the third embodiment of the present invention. The integrated stacked transformer in this embodiment can be applied to be a transformer or a BALUN in radio frequency integrated circuit. The integrated stacked transformer is formed by a first metal layer and a second metal layer, wherein the pattern of the first metal layer is in slash, and the first metal layer comprises two input/output ports 311_1 and 311_2, a first turn winding 310_1, a second turn winding 310_2 and a third turn winding 310_3; and the pattern of the second metal layer is in dot, and the second metal layer comprises two input/output ports 321_1 and 321_2, a first turn winding 320_1, a second turn winding 320_2, a third turn winding 320_3 and a fourth turn winding 320_4. In addition, both the first metal layer and the second metal layer comprise a plurality of via holes arranged to connect the first metal layer with the second metal layer.

The embodiment in FIG. 3C is similar with the integrated stacked transformer in FIG. 2C, the only difference is that the secondary inductor of the integrated stacked transformer of FIG. 3 comprises a third turn formed by the first metal layer. Refer to the cross-sectional view of A-A' of FIG. 3, comparing to the integrated stacked transformer in FIG. 2C, the primary inductor and the secondary inductor of the integrated stacked transformer in FIG. 3 form an additional mutual inductance in the innermost turn to improve the quality factor Q of the integrated stacked transformer.

Figure 4:
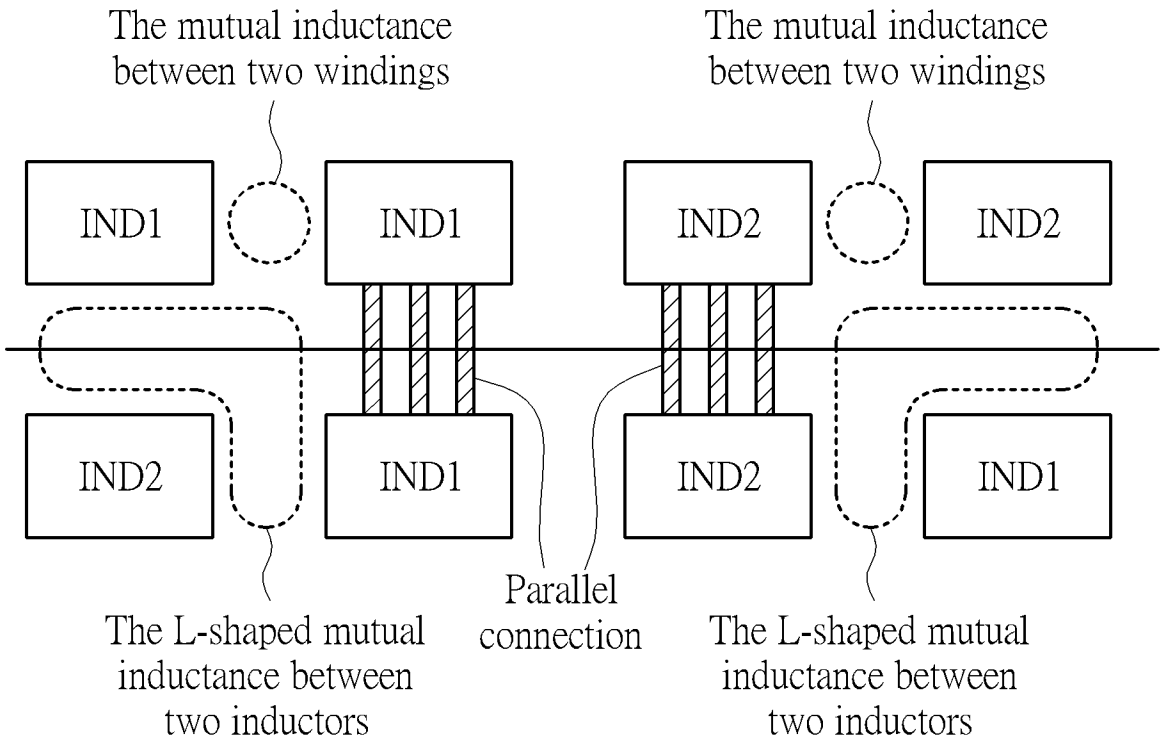
FIG. 4 is a diagram illustrating the cross-sectional view of the integrated stacked transformer according to another embodiment of the present invention.

In addition, there is no winding formed by the first metal layer above the third turn of the second metal layer of the integrated stacked transformer of FIG. 3, therefore, in another embodiment of the present invention, the integrated stacked transformer in FIG. 3 may be modified by adding a winding formed by the first metal layer above the third turn of the second metal layer, and the third turn of the first metal layer and the third turn of the second metal layer are connected in parallel as shown in FIG. 4. In FIG. 4, IND1 is the primary inductor, and IND2 is the secondary inductor, and the primary inductor and the secondary inductor form a L-shaped mutual inductance between two inductors, therefore the quality factor of the integrated stacked transformer can be greatly improved.

Figure 5A:
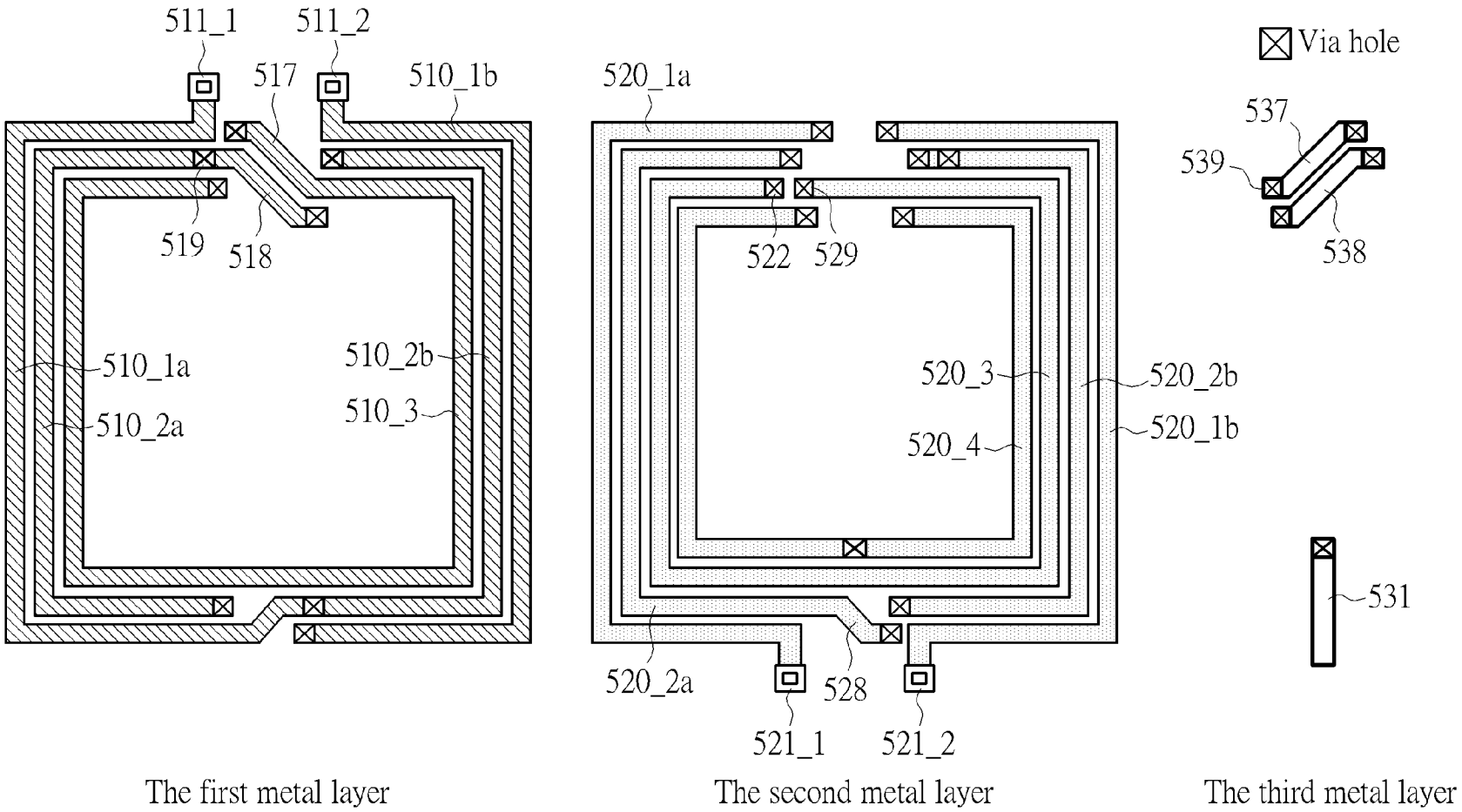
FIG. 5A is a diagram illustrating the patterns of two metal layers of the integrated stacked transformer according to the fourth embodiment of the present invention.
Figure 5B:
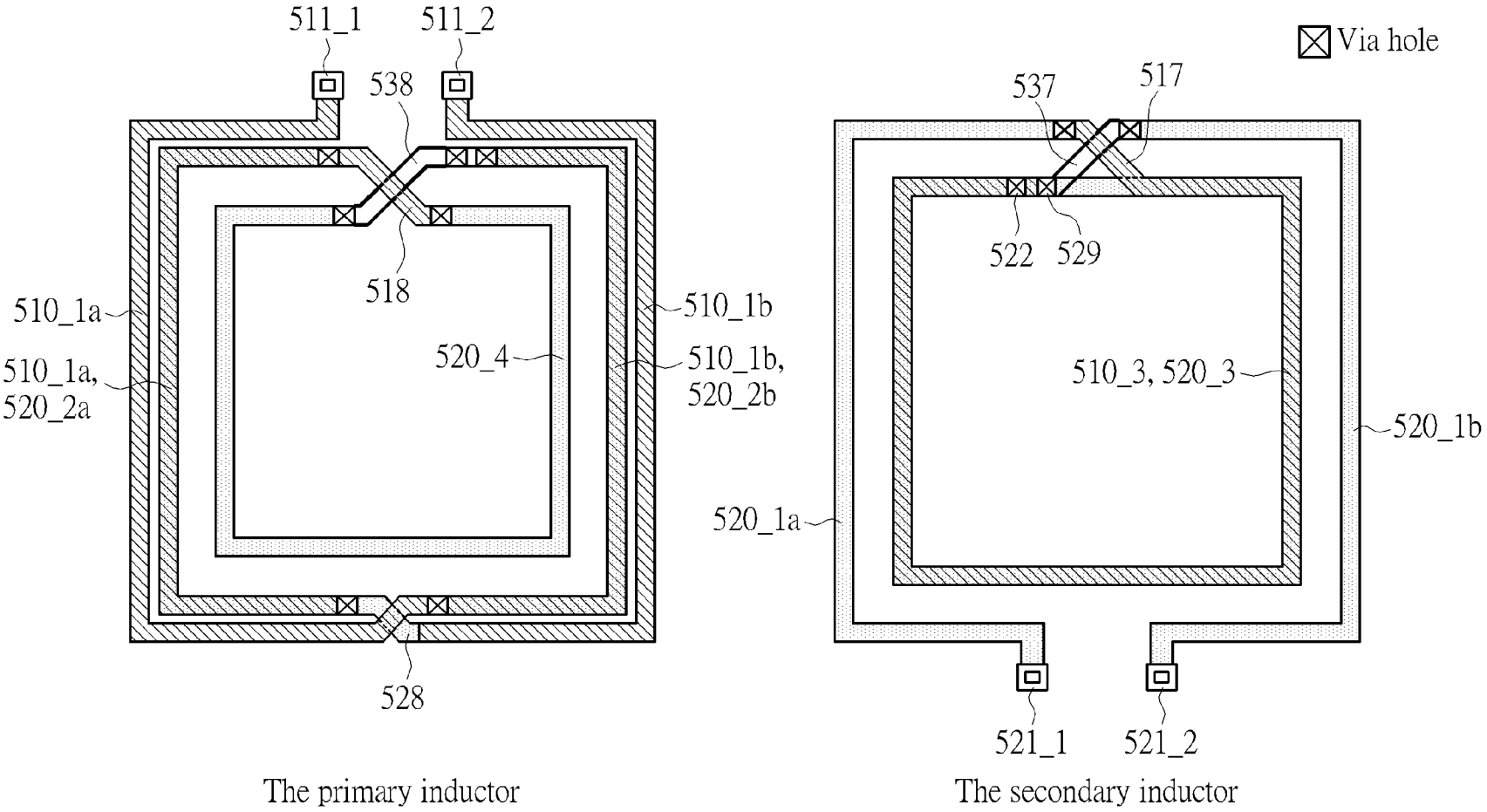
FIG. 5B is a diagram illustrating the primary inductor and the secondary inductor of the integrated stacked transformer in FIG. 5A.
Figure 5C:
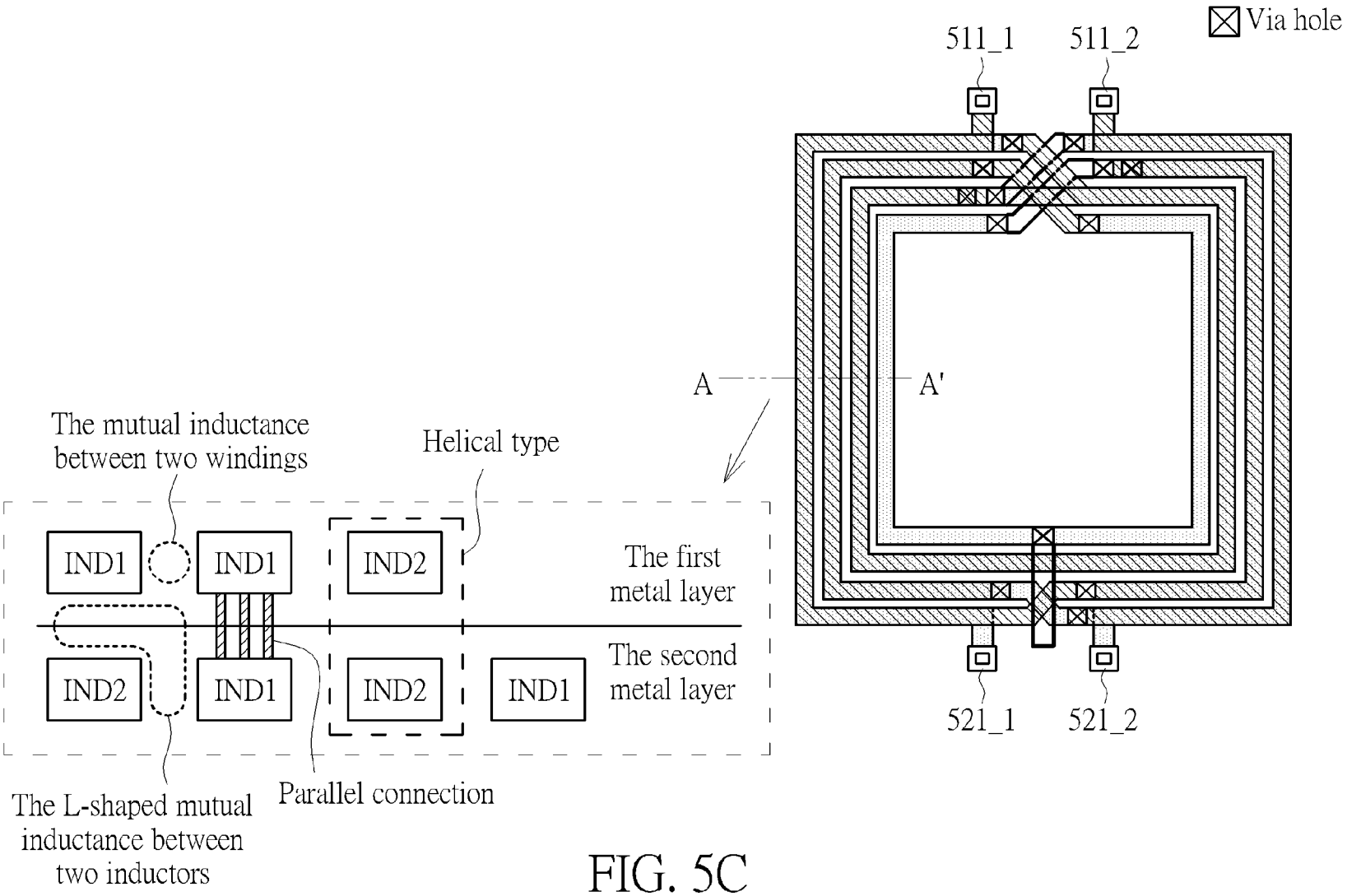
FIG. 5C is the top view and the cross-sectional view of the integrated stacked transformer according to the fourth embodiment of the present invention.

Refer to FIG. 5A, FIG. 5B and FIG. 5C, wherein FIG. 5A is a diagram illustrating the patterns of two metal layers of the integrated stacked transformer according to the fourth embodiment of the present invention, FIG. 5B is a diagram illustrating the primary inductor and the secondary inductor of the integrated stacked transformer according to the fourth embodiment of the present invention, and FIG. 5C is a diagram illustrating the top view of the integrated stacked transformer according to the fourth embodiment of the present invention. The integrated stacked transformer in this embodiment can be applied to be a transformer or a BALUN in radio frequency integrated circuit, Refer to FIG. 5A, the integrated stacked transformer is formed by a first metal layer and a second metal layer, and the integrated stacked transformer further comprises small parts of the third metal layer, wherein the pattern of the first metal layer comprises two input/output ports 511_1 and 511_2, two bridges 517 and 518, a first turn winding which comprises left half turn winding 510_1*a* and right half turn winding 510_1*b*, a second turn winding which comprises left half turn winding 510_2*a* and right half turn winding 510_2*b* and a third turn winding 510_3, and the pattern of the second metal layer comprises two input/output ports 521_1 and 521_2, a first turn winding which comprises left half turn winding 520_1*a* and right half turn winding 520_1*b*, a second turn winding which comprises left half turn winding 520_2*a* and right half turn winding 520_2*b*, a third turn winding 520_3 and a fourth turn winding 520_4, wherein the bridge 517 is arranged to connect the left half turn winding 520_1*a* of the first turn winding of the second metal layer with the third turn winding 510_3 of the first metal layer, the bridge 518 is arranged to connect the fourth turn winding 520_4 of the second metal layer with the left half turn winding 510_2*a* of the second turn winding of the first metal layer (or can be regarded as connecting the fourth turn winding 520_4 of the second metal layer with the left half turn winding 520_2*a* of the second turn winding of the second metal layer), and the bridge 528 is arranged to connect the right half turn winding 510_1*b* of the first turn winding of the first metal layer with the left half turn winding 520_2*a* of the second turn winding of the second metal layer (or can be regarded as connecting the right half turn winding 510_1*b* of the first turn winding of the first metal layer with the left half turn winding 510_2*a* of the second turn winding of the first metal layer). In addition, both the first metal layer and the second metal layer comprise a plurality of via holes arranged to connect the first metal layer with the second metal layer. For example, the via hole 519 of the first metal layer in FIG. 5A is electrically connected to the via hole 529 of the second metal layer, and the via hole 522 of the second metal layer is electrically connected to the via hole 539 of the third metal layer.

In addition, the third metal layer comprises two bridges 537, 538 and a center tap winding 531, wherein the bridge 537 is arranged to connect the right half turn winding 520_1*b* of the first turn winding of the second metal layer with the third turn winding 520_3 of the second metal layer, the bridge 538 is arranged to connect the right half turn winding 520_2*b* of the second turn winding of the second metal layer with the fourth turn winding 520_4 of the second metal layer, and the center tap winding 531 is connected to the center of the secondary inductor.

In this embodiment, the first metal layer is RDL, and the second metal layer is UTM, and the first metal layer, the second metal layer and the third metal layer are three adjacent metal layers from the top to the bottom, however, this is not a limitation of the present invention. In other embodiments of the present invention, the first metal layer, the second metal layer and the third metal layer can be any three adjacent metal layers in the integrated circuit.

Next, refer to FIG. 5A, FIG. 5B and FIG. 5C, the integrated stacked transformer in this embodiment comprises a primary inductor and a secondary inductor, wherein the primary inductor is electrically isolated from the secondary inductor, and the primary inductor comprises a first turn, a second turn and a third turn, and the secondary inductor comprises a first turn and a second turn. Refer to FIG. 5B, the first turn of the primary inductor except the area around the bridges 518, 528, and 538 is formed by the first turn winding of the first metal layer which comprises the left half turn winding 510_1*a* and the right half turn winding 510_1*b*, the second turn of the primary inductor is a parallel connection structure constructed by the second turn winding of the first metal layer which comprises the left half turn winding 510_2*a* and the right half turn winding 510_2*b* and the second turn winding of the second metal layer which comprises the left half turn winding 520_2*a* and the right half turn winding 520_2*b*, the third turn of the primary inductor is formed by the fourth turn winding 520_4. In addition, the first turn of the secondary inductor except the area around the bridges 517 and 537 is formed by the first turn winding of the second metal layer which comprises the left half turn winding 520_1*a* and the right half turn winding 520_1*b*, and the second turn of the secondary inductor is formed by the helical connection of the third turn winding 510_3 of the first metal layer and the third turn winding 520_3 of the second metal layer.

In addition, the second turn of the primary inductor is a parallel connection structure constructed by the second turn winding of the first metal layer which comprises the left half turn 510_2*a* and the right half turn winding 510_2*b* and the second turn winding of the second metal layer which comprises the left half turn winding 520_2*a* and the right half turn winding 520_2*b*. For the tidiness of figure, in FIG. 5B it only depicts four via holes arranged to connect the second turn winding of the first metal layer with the second turn winding of the second metal layer, however, in practice, the second turn winding of the first metal layer and the second turn winding of the second metal layer can be connected in parallel through a lot of via holes, or even via holes can be disposed all over the windings.

In addition, in FIG. 5B, the second turn of the secondary inductor is formed by the helical connection of the third turn winding 510_3 of the first metal layer and the third turn 520_3 of the second metal layer, so the secondary inductor substantially has three turns, that is the turn ratio of the primary inductor and the secondary inductor of the integrated stacked transformer of FIG. 5A is 1:1.

Refer to the top view of the integrated stacked transformer in FIG. 5C, the first turn winding of the first metal layer (i.e. the first turn of the primary inductor) and the first turn winding of the second metal layer (i.e. the first turn of the secondary inductor) are overlapped. In the cross-sectional view of A-A' of FIG. 5C, IND1 is the primary inductor, IND2 is the secondary inductor. The first turn winding and the second turn winding of the first metal layer of the primary inductor form a mutual inductance between two windings, and the first turn of the secondary inductor (the first turn winding of the second metal layer) and the first turn winding, the second turn winding of the first metal layer and the second turn winding of the second metal layer of the primary inductor form a L-shaped mutual inductance between two inductors, therefore the quality factor Q of the integrated stacked transformer can be greatly improved. In addition, because the secondary inductor has the helical second turn, the mutual inductance between the primary inductor and the secondary inductor may be further improved.

In addition, although the integrated stacked transformers in FIG. 5A, FIG. 5B and FIG. 5C use three metal layers, however, most of the structure can be implemented with only two metal layers, therefore it can save the space in the integrated circuit to reduce manufacturing costs. In addition, the second metal layer in this embodiment is UTM which has the lowest resistance in metal process, so the resistance of the inductors may be improved to enhance the quality factor.

Although most of the structure of the integrated stacked transformers of FIG. 5A, FIG. 5B and FIG. 5C can be implemented with only two metal layers, however, sometimes for other reasons such like improving the quality factor or there are some available spaces in integrated circuit, one or more extra metal layers may be used to form a stacked structure. For example, the third metal layer or the fourth metal layer may be used to connect with a portion of windings of either the primary inductor or the secondary inductor in parallel. These adjustments of design are supposed to be defined in the scope of the present invention.

Although in the embodiment in FIG. 5A, FIG. 5B and FIG. 5C, the second turn of the primary inductor is a parallel connection structure constructed by the second turn winding of the first metal layer which comprises the left half turn winding 510_2*a* and the right half turn winding 510_2*b* and the second turn winding of the second metal layer which comprises the left half turn winding 520_2*a* and the right half turn winding 520_2*b*, however, in other embodiments in the present invention, only a portion of segments of the second turn of the primary inductor it is designed to have the parallel connection structure, that is not all of the second turn of the primary inductor has the parallel connection structure. These adjustments of design are supposed to be defined in the scope of the present invention.

Figure 6A:
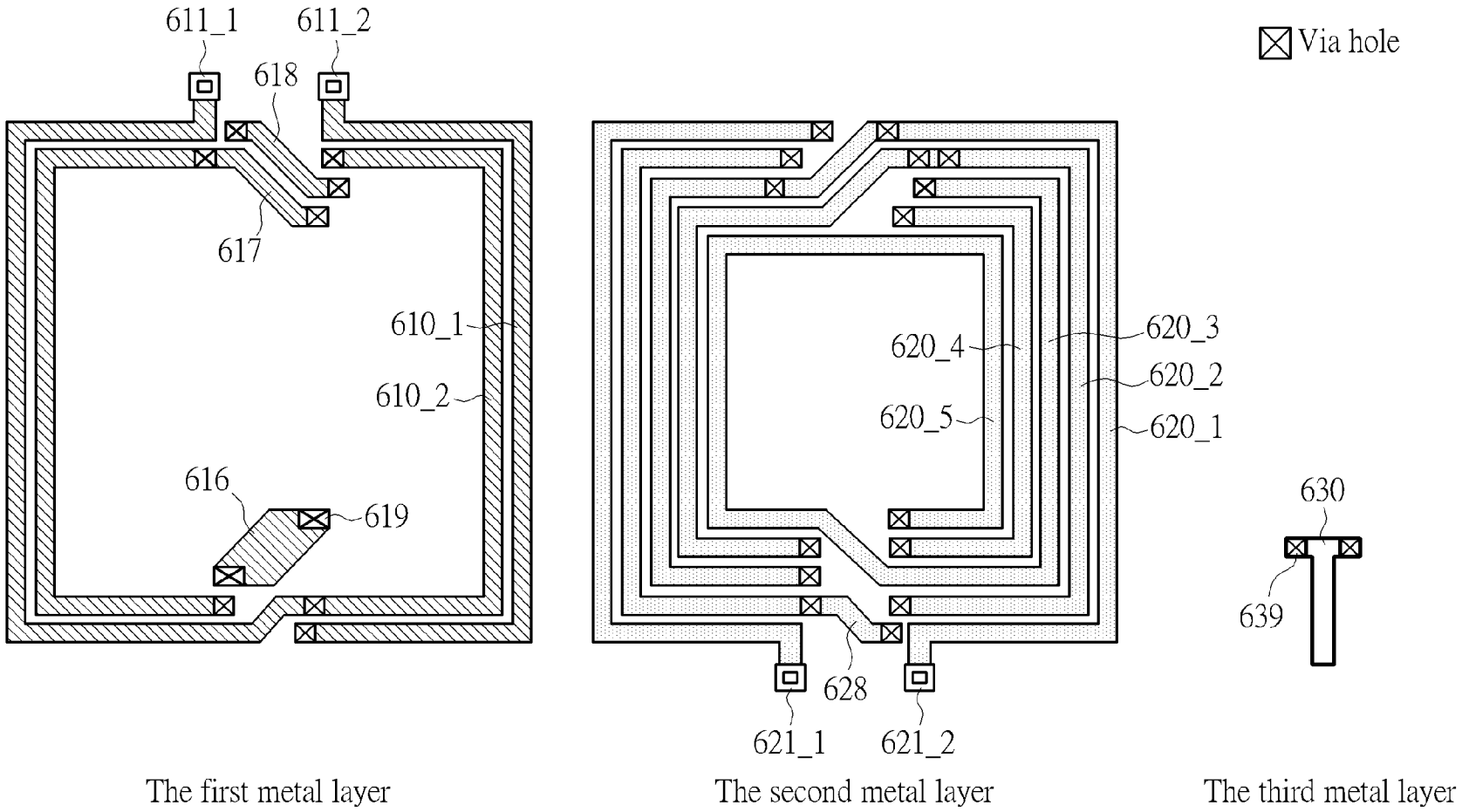
FIG. 6A is a diagram illustrating the patterns of two metal layers of the integrated stacked transformer according to the fifth embodiment of the present invention.
Figure 6B:
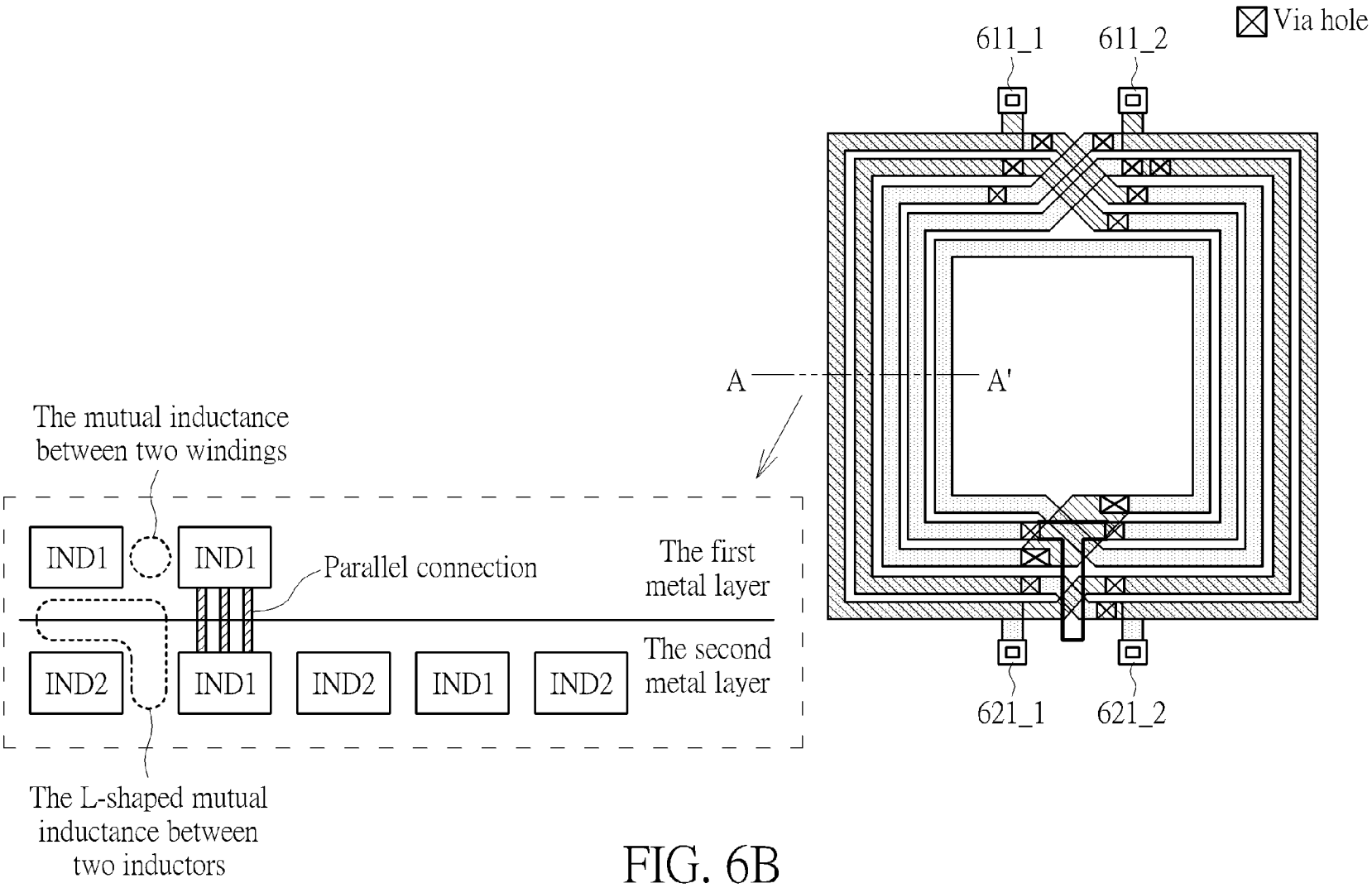
FIG. 6B is a diagram illustrating the top view and the cross-sectional view of the integrated stacked transformer according to the fifth embodiment of the present invention.

Refer to FIG. 6A and FIG. 6B, wherein FIG. 6A is a diagram illustrating the patterns of two metal layers of the integrated stacked transformer according to the fifth embodiment of the present invention, and FIG. 6B is a diagram illustrating the top view of the integrated stacked transformer according to the fifth embodiment of the present invention. The integrated stacked transformer in this embodiment can be applied to be a transformer or a BALUN in radio frequency integrated circuit.

Refer to FIG. 6A, the integrated stacked transformer is formed by a first metal layer and a second metal layer, wherein the pattern of the first metal layer comprises two input/output ports 611_1, 611_2, three bridges 616, 617, 618, a first turn winding 610_1 which comprises left half turn and right half turn and a second turn winding 610_2 which comprises left half turn and right half turn, and the pattern of the second metal layer comprises two input/output ports 621_1, 621_2, a bridge 618, a first turn winding 620_1 which comprises left half turn and right half turn, a second turn winding 620_2 which comprises left half turn and right half turn, a third turn winding 620_3 which comprises left half turn and right half turn, a fourth turn winding 620_4 which comprises left half turn and right half turn, and a fifth turn winding 620_5, wherein the bridge 616 is arranged to connect the third turn winding 610_3 of the second metal layer with the fifth turn winding 620_5 of the second metal layer, the bridge 617 is arranged to connect the second turn winding 610_2 of the first metal layer with the fourth turn winding 620_4 of the second metal layer (or can be regarded as connecting the second turn winding 620_2 of the second metal layer with the fourth turn winding 620_4 of the second metal layer), the bridge 618 is arranged to connect the first turn winding 610_1 of the second metal layer with the third turn winding 620_3 of the second metal layer, and the bridge 628 is arranged to connect the first turn winding 610_1 of the first metal layer with the second turn winding 610_2 of the first metal layer (or can be regarded as connecting the first turn winding 610_1 of the first metal layer with the second turn winding 620_2 of the second metal layer). In addition, both the first metal layer and the second metal layer comprise a plurality of via holes arranged to connect the first metal layer with the second metal layer. For example, the via hole 619 of the first metal layer is electrically connected to the via hole 629 of the second metal layer in FIG. 6A.

In addition, the winding 630 of the third metal layer can be taken as a bridge and a center tap, wherein the winding 630 is connected to the two terminals of the fourth turn winding 620_4 of the second metal layer, and the winding 630 can also be connected to a fixed voltage as a center tap.

In this embodiment, the first metal layer is RDL and the second metal layer is UTM, and the first metal layer, the second metal layer and the third metal layer are three adjacent metal layers from the top to the bottom, however, this is not a limitation of the present invention. In other embodiments, the first metal layer, the second metal layer and the third metal layer can be any three adjacent metal layers in the integrated circuit.

The three metal layers in FIG. 6B can form an integrated stacked transformer which has a primary inductor and a secondary inductor. Refer to the top view of the integrated stacked transformer in FIG. 6B, in the cross-sectional view of A-A' in FIG. 6B, IND1 is the primary inductor, and IND2 is the secondary inductor, the first turn winding 610_1 and the second turn winding 610_2 of the first metal layer of the primary inductor can form a mutual inductance between two windings, and the first turn of the secondary inductor (the first turn winding 620_1 of the second metal layer) and the first turn winding 610_1, the second turn winding 610_2 of the first metal layer and the second turn winding 620_2 of the second metal layer of the primary inductor form a L-shaped mutual inductance between two inductors, therefore the quality factor Q of the integrated stacked transformer can be greatly improved. In addition, the third turn of the primary inductor (i.e. the fourth turn winding 620_4 of the second metal layer) and the second turn/third turn of the secondary inductor (i.e. the third turn winding 620_3 and the fifth turn winding 620_5 of the second metal layer) form another mutual inductance to further improve the quality factor of the integrated stacked transformer.

In addition, although the integrated stacked transformers in FIG. 6A, FIG. 6B use three metal layers, however, most of structure can be implemented with only two metal layers, therefore it can save the space in integrated circuit to reduce manufacturing costs. In addition, the second metal layer in this embodiment is UTM which has the lowest resistance in metal process, so the resistance of the inductors may be improved to enhance the quality factor.

Although most of the structure of the integrated stacked transformers in FIG. 6A, and FIG. 6B can be implemented with only two metal layers, however, sometimes for other reasons such like improving the quality factor or there are some available spaces in integrated circuit, one or more extra metal layers may be used to form a stacked structure. For example, the third metal layer or the fourth metal layer with a portion of windings of either the primary inductor or the secondary inductor in parallel. These adjustments of design are supposed to be defined in the scope of the present invention.

Although in the embodiment in FIG. 6A, and FIG. 6B, the second turn of the primary inductor is a parallel connection structure constructed by the second turn winding 610_2 of the first metal layer and the second turn winding 620_2 of the second metal layer, however, in other embodiments of the present invention, only a portion of segments of the second turn of the primary inductor is designed to have the parallel connection structure, that is not all of the second turn of the primary inductor has the parallel connection structure. These adjustments of design are supposed to be defined in the scope of the present invention.

In addition, in embodiments of FIG. 1A to 1C, FIG. 2A to 2C, FIG. 3, FIG. 5A to 5C, and FIG. 6A to 6B, the windings of the inductors are all square, however, in other embodiments of the present invention, the windings can be hexagonal or octagon or even circle. These adjustments of design are supposed to be defined in the scope of the present invention.

In addition, in embodiments of FIG. 1A to 1C, FIG. 2A to 2C, and FIG. 3, the integrated stacked transformers don't have center taps, however, if the embodiments of FIG. 1A to 1C, FIG. 2A to 2C, and FIG. 3 need to add a center tap, a third metal layer may be used by referring to the embodiments shown in FIG. 5A to 5C and FIG. 6A to 6B. Because a skilled person in the art should understand how to modify the embodiments of FIG. 1A to 1C, FIG. 2A to 2C, and FIG. 3 to add a center tap by referring to the embodiments of FIG. 5A to 5C, and FIG. 6A to 6B, further descriptions are omitted here for brevity.

In addition, in the embodiments of the present invention, the integrated stacked transformers only comprise two inductors. However, in other embodiments, the integrated stacked transformer can comprise three or four inductors. For example, extra metal layers above or under the integrated stacked transformers stated in FIG. 1A to 1C, FIG. 2A to 2C, FIG. 3, FIG. 5A to 5C, FIG. 6A and FIG. 6B may be used to dispose one or two extra inductors. These adjustments of design are supposed to be defined in the scope of the present invention.

Briefly summarized, in the integrated stacked transformer of the present invention, most of it only use two metal layers, and the mutual inductance in the primary inductor is increased and the mutual inductance between the primary inductor and the secondary inductor is greatly increased by using the special windings. Therefore, comparing to prior arts, the present invention can improve the quality factor of the integrated stacked transformer and also save space.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An integrated stacked transformer, comprising:

a primary inductor, wherein the primary inductor comprises at least a first turn and a second turn, and the primary inductor is at least formed by a plurality of windings of a first metal layer and a second metal layer, and the second turn of the primary inductor is disposed inside the first turn; and a secondary inductor, wherein the secondary inductor comprises at least a first turn, and the secondary inductor is at least formed by at least one winding of the second metal layer, and the first turn of the secondary inductor and the first turn of the primary inductor are substantially overlapped;

wherein the second turn of the primary inductor comprises a parallel connection structure formed by a segment of the first metal layer and a segment of the second metal layer, and the segment of the first metal layer and the segment of the second metal layer are overlapped.

2. The integrated stacked transformer of claim 1, wherein the primary inductor is symmetric, and except areas around bridges, the first turn of the primary inductor is substantially formed by the first metal layer, and the second turn of the primary inductor is a parallel connection structure constructed by the first metal layer and the second metal layer.

3. The integrated stacked transformer of claim 1, wherein the integrated stacked transformer is formed by only the first metal layer and the second metal layer without other metal layers.

4. The integrated stacked transformer of claim 1, wherein the primary inductor further comprises a third turn, and the third turn of the primary inductor is disposed inside the second turn; and the secondary inductor further comprises a second turn, and the second turn of the secondary inductor is disposed inside the first turn.

5. The integrated stacked transformer of claim 4, wherein except areas around bridges, the third turn of the primary inductor and the second turn of the secondary inductor are substantially only formed by the second metal layer.

6. The integrated stacked transformer of claim 4, wherein the secondary inductor further comprises a third turn, and the third turn of the secondary inductor is disposed inside the second turn, and the third turn of the secondary inductor is substantially formed by the first metal layer, and at least a portion of the third turn of the secondary inductor overlaps at least a portion of the third turn of the primary inductor.

7. The integrated stacked transformer of claim 4, wherein except areas around bridges, the second turn of the secondary inductor comprises a segment of a parallel connection structure formed by the first metal layer and the second metal layer.

8. The integrated stacked transformer of claim 4, wherein except areas around bridges, the second turn of the secondary inductor is formed by a helical connection of the first metal layer and the second metal layer.

9. The integrated stacked transformer of claim 4, the secondary inductor further comprises a third turn, and the third turn of the secondary inductor is disposed inside the second turn, and the third turn of the primary inductor is disposed between the second turn and the third turn of the secondary inductor.

10. The integrated stacked transformer of claim 9, wherein except areas around bridges, the third turn of the primary inductor and the second turn, the third turn of the secondary inductor are substantially only formed by the second metal layer.

11. The integrated stacked transformer of claim 1, wherein a center of either the primary inductor or the secondary inductor is connected to a center tap, and the center tap is formed by a third metal layer.

12. The integrated stacked transformer of claim 1, wherein the first metal layer is re-distribution layer, and the second metal layer is ultra-thick metal layer.

13. The integrated stacked transformer of claim 1, wherein the primary inductor and the secondary inductor form a mutual inductance by a vertical coupling, a diagonal coupling and a horizontal coupling.

* * * * *